US011217935B2

(12) United States Patent
Montoya

(10) Patent No.: US 11,217,935 B2
(45) Date of Patent: Jan. 4, 2022

(54) RADIO FREQUENCY CABLE HOUSING SOLUTION WITH SELF ALIGNING AND RECONFIGURATION CAPABILITY

(71) Applicant: ELMA ELECTRONIC INC., Fremont, CA (US)

(72) Inventor: Klaus Montoya, Livermore, CA (US)

(73) Assignee: ELMA ELECTRONIC INC., Fremont, CA (US)

( * ) Notice: Subject to any disclaimer, the term of this patent is extended or adjusted under 35 U.S.C. 154(b) by 0 days.

(21) Appl. No.: 16/446,768

(22) Filed: Jun. 20, 2019

(65) Prior Publication Data

US 2019/0393645 A1 Dec. 26, 2019

Related U.S. Application Data

(60) Provisional application No. 62/689,127, filed on Jun. 23, 2018.

(51) Int. Cl.

| | |
|---|---|
| ***H01R 13/625*** | (2006.01) |
| ***H01R 13/58*** | (2006.01) |
| ***H01R 9/05*** | (2006.01) |
| ***H01R 24/54*** | (2011.01) |

(52) U.S. Cl.

CPC ..... *H01R 13/5804* (2013.01); *H01R 9/0506* (2013.01); *H01R 24/542* (2013.01); *H01R 24/545* (2013.01)

(58) Field of Classification Search

CPC ..... H01R 13/6275; H01R 13/639; H01R 13/62933; H01R 23/7005

USPC ..... 439/345, 953, 378, 372

See application file for complete search history.

(56) References Cited

U.S. PATENT DOCUMENTS

| | | | | |
|---|---|---|---|---|
| 2003/0082950 A1* | 5/2003 | Tang | H01R 9/0524 | 439/582 |
| 2009/0035987 A1* | 2/2009 | Daly | H01R 24/30 | 439/502 |

* cited by examiner

*Primary Examiner* — Phuong Chi Thi Nguyen

(74) *Attorney, Agent, or Firm* — Law Offices of Sanjay Bhardwaj; Sanjay Bhardwaj

(57) ABSTRACT

A method and apparatus is presented for strain relief for mil-spec RF cabling connectors. When the RF signals are carried on the cables, they are either attached to connectors to increase their lengths or they get attached to hardware assembly that receives and transmits RF signals. At connections, strain relief is provided so that any movement of the cables does not convey stress and strain to the points where cable joins the connector or its mate. A concise, space restricted strain relief solution is provided by use of clamp, cover or shrink tubing to transfer cables in all four directions. The concentric cables line up in small dimensions and are replaceable individually as opposed to discard of entire mesh of cables on single cable failure.

14 Claims, 10 Drawing Sheets

(ISOMETRIC VIEW, STANDING, BACK ON TOP)

(ISOMETRIC VIEW, STANDING, BACK ON TOP)

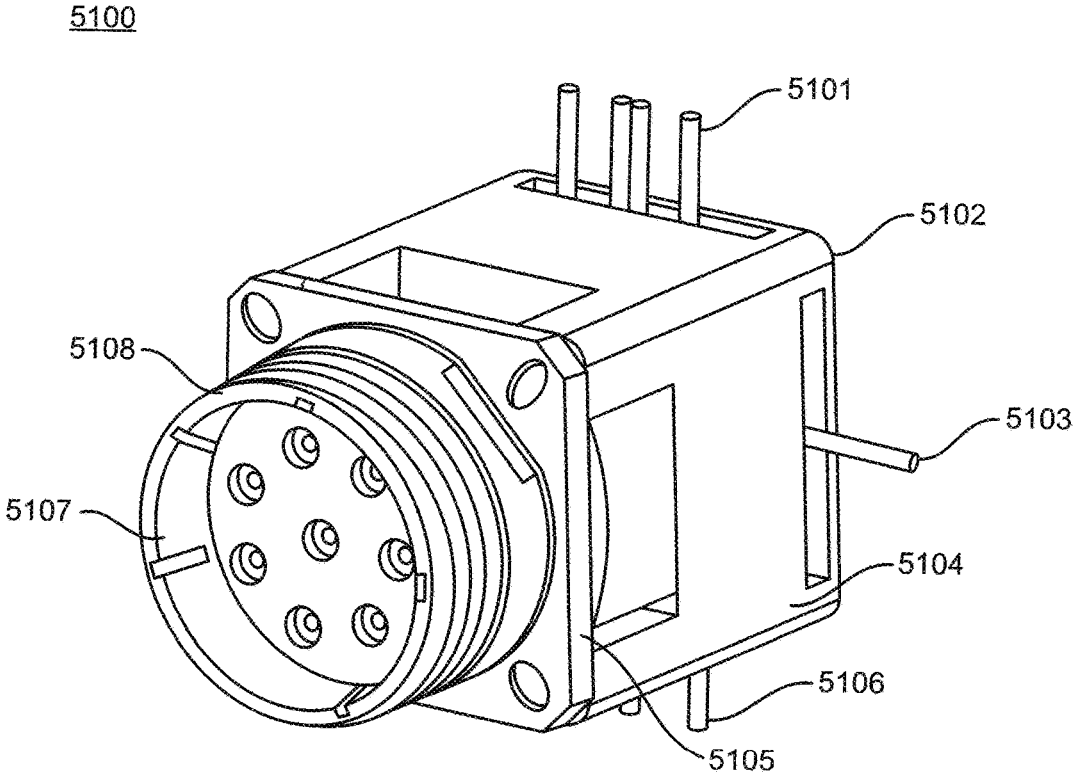
FIG. 5.1
(ISOMETRIC VIEW, FLAT, CABLE CONNECTION in FRONT)

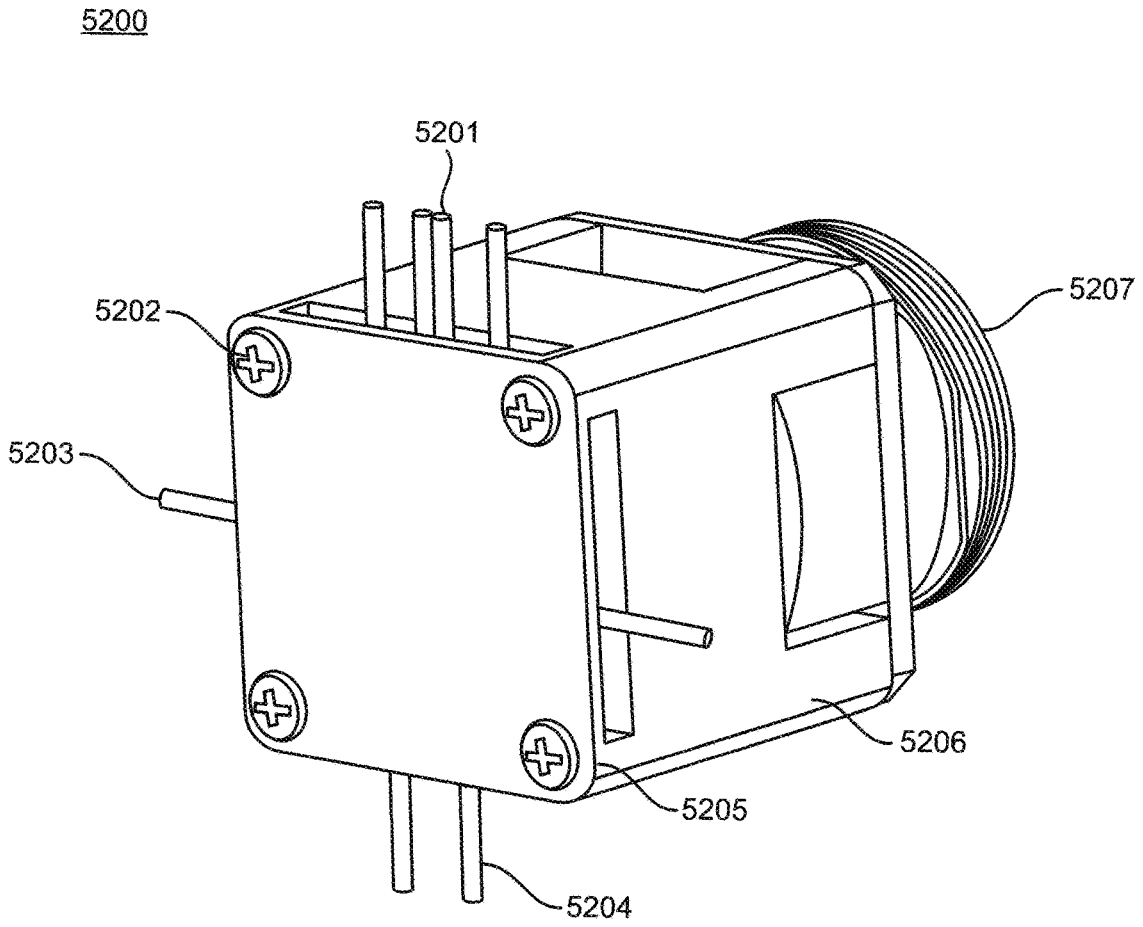
FIG. 5.2
(ISOMETRIC VIEW, FLAT, BACK SIDE IN FRONT)

700

RADIO FREQUENCY CABLE HOUSING SOLUTION WITH SELF ALIGNING AND RECONFIGURATION CAPABILITY

BENEFIT OF EARLIER FILING DATE OF PRIORITY

This non-provisional patent application claims benefit of priority date through specific reference to provisional patent application No. 62/689,127 filed on Jun. 23, 2018 under 35 U.S.C, 119 (e) (1). See also 37 C.F.R. 1.78.

FIELD OF THE INVENTION

The present invention relates generally to connectors deployed for radio frequency (RE) cables. More specifically, the present invention is a solution to strain relief provided when cables get attached to other cables or to hardware apparatus. Due to long lengths and several degrees of freedom of movement, without strain relief, the entire torque or strain of the tendency to move shall fall on the connection points. Strain relief is therefore provided to restrict degrees of freedom and movement from around the connection points to clamp points which are designed to absorb shocks due to movements. A new strain relief method and apparatus is presented for RF cabling, saving costs on replacements, providing compactness and providing better alignment on concentric connections.

BACKGROUND OF THE INVENTION

Electronic systems comprise, among other things, a plurality of printed circuit boards with electronic components. Such components may be application specific integrated circuits (ASICs), field programmable gate arrays (FPGAs), dynamic random access memories (DRAMs), flash memories, central processing units (CPUs), read only memories (ROMs), capacitors, inductors, resistors and wires. The design of boards is targeted to various interfaces that differ in form factor, protocol, speed and power consumption. The electronic systems in communications employ radio frequency receive and transmit interfaces. The signals are carried to and from an antenna on cables that collect received signals and also serves as the transmit point for signals from the electronic system to the antenna. In general, either the cables terminate on the electronic system hardware or they are connected through coupler to connect to a similar cable to effectively increase the length of the cable.

At the joint point, electrical connections are made between the wires assembled from the cables and the hardware apparatus which could be a radio capable of receiving and transmitting RF signals. The cables are long and either during the connection or much after that, the cables may move for various reasons. This causes the torque of stress to directly impact the connection joint between the connector and cable. If no support is provided, the electrical connection can break, leading to functional failures. Such failures are costly, may involve entire cable replacement because the end connector is no longer working. In another embodiment, such torque of movement may be passed on to a cable to cable connector. Again failure at connection point even in this case is costly. Entire cable may have to be discarded and failures may lead to substantial down times. The shock of movement or torque passed to the connection points are stopped from reaching the critical connection points through the use of strain relief mechanisms. The cable may go through metallic or nylon casing, may go through clamp points that restrict the movements around the connection points and directional turns may also be provided through the strain relief mechanisms and apparatus.

For the RF cabling, the signals are carried on concentric cables. Alignment of the center wire poses peculiar problems. Further this problem becomes worse due to the connector attach points. Connectors are designed to have a strain relief, and in most cases strain relief is indispensable. In general, connectors are designed so that when the two connectors are mated, the contact should self-align. When working with RF contacts, this becomes more complicated, due to the inherent design of RF contacts. In theory they should align as the connectors are mated. This does not always happen, especially when strain reliefs are used. That is the reason that engineers prefer to have one of the connectors contact fixed.

When providing strain relief for Mil-specification connector, the current strain relief products do not allow for RF contacts used in Mil-inch specification connectors to stay concentric within the cavity hole they are installed into. Once the clamp is tightened, which is part of the strain relief; it causes the RF Cables to lean towards one side of the other of the cavity. Also, current strain relief mechanisms are too large for small space applications. A costly solution is to design a custom strain relief back shell, install all RF Cables, and then fill with an epoxy to secure the contacts so there is no movement at all. The epoxy process has a major flaw in its design. If there is a failure to one or more of the cables within the connector housing, after the epoxy process is completed, the cable assembly must be scrapped and cannot be reworked.

The present invention overcomes this problem, by providing a new and compact strain relief mechanism for strain relief for RF cabling. To a connector providing a plurality of connection points for RF cables, a back shell is attached in one embodiment and using a clamp with shrink tubing, the cables are clamped using screws and washers to attach clamp with the back shell. In another embodiment, the clamp or cover is extended in all four directions, providing a four directional possibility to direct the cables outwards from the connection point. This embodiment is used where the cables need to turn in all four directions from the connection point. The clamp or cover is only in one dimension where cables need to turn only in one direction. No potted or epoxy material is used to restrict the degrees freedom, so that a single cable replacement is possible rather than discarding the entire set of cables.

BRIEF DESCRIPTION OF THE DRAWINGS

FIG. 5.1 represents another view of the embodiment of FIG. 5. The cables in each direction, the clamp or cover extended in each direction, the back shell and the connector are shown with cables populated. Each cable is given a circular opening guidance so that the connection remains physically solid. Also, once the connection is made, using the back shell and the clamp, the cable is turned, with possibility in each direction, without stressing the connection point.

FIG. 5.2 is the back view of the embodiment represented in FIG. 5.1. The clamp or cover is clearly shown to be attached to the back shell through four screws. The cables are shown to be turned in all four directions, with the back shell attached to the connector.

DETAIL DESCRIPTIONS OF THE INVENTION

Figure 1:
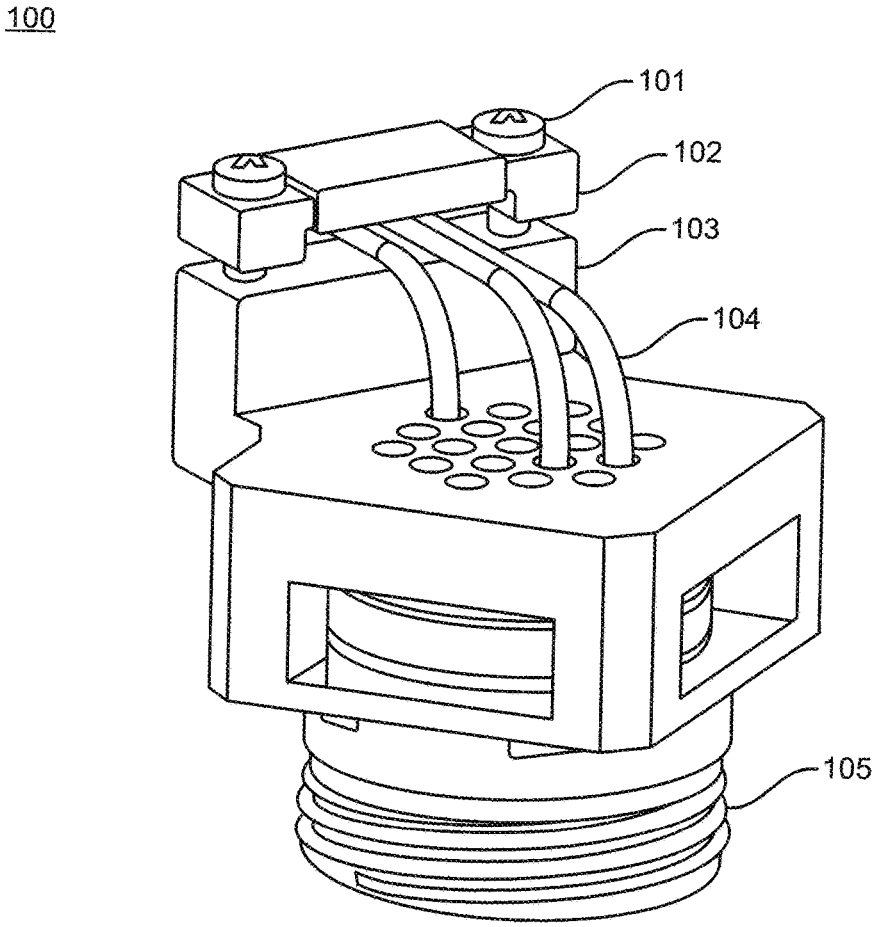
FIG. 1 is one embodiment of the strain relief solution proposed in the present invention. To the connector, a back shell is attached which has holes lined up to match the corresponding holes on the connector. A set of cables come through the holes lined up between connector and back shell. The cables are clamped using a clamp with shrink tubing, which is attached to back shell using screws and washers. An isometric view is shown

All illustrations of the drawings are for the purpose of describing selected versions of the present invention and are not intended to limit the scope of the present invention.

In the following description specific details are set forth describing certain embodiments. It will be apparent, however, to one skilled in the art that the disclosed embodiments may be practiced without some or entire specific details mentioned herein. The specific embodiments presented are meant to be illustrative, but not limiting. One skilled in the art may realize other material that, although not specifically described herein, is within the scope and spirit of this disclosure.

In one embodiment of the apparatus, in the design of electrical and mechanical systems, one important component among a plurality of the components is a printed circuit board (PCB). The printed circuit board could be a single instantiation in the electrical system or it may exists in multiple instantiations of the same printed circuit board. In another embodiment, the electrical system may comprise of multiple printed circuit boards that the functionally and physically different, communication with each other through a backplane connector or through cables carrying network or communication signals. In one embodiment, such signals may be RF signals. In another embodiment, this communication could be through ribbon or other cables or wires secured or otherwise used within the system. In another embodiment, a printed circuit board may connect to one or more daughter cards which are typically smaller in size than the printed circuit board (also sometimes referred as a mother board). For remote electrical signals, the cables are attached to hardware assembly, including printed circuit boards through connectors. In another apparatus, a certain length of cables may attach to another cable through a connector. For RF signals, the cable may involve concentric wires, with the connector ensuring alignment.

In a typical electrical system, a printed circuit board provides a platform or space where electronic components are placed and populated. These components include but are not restricted to Application Specific Integrated Circuits (ASIC), Field Programmable Gate Array (FPGA), a plurality of memory chips or modules, capacitors, resistors, connectors and interconnect among others. Connectors are used where remote signals are brought to this apparatus through cables of various kinds. For a printed circuit board used in a set top box for dish TV reception, a set of RF cables are brought from the dish antenna to the set top box's printed circuit board and connected to the radio on the printed circuit board through connectors. While connection is made or after that, it is natural that the long distance cables shall move for various reasons. Without any strain relief, the movement of the long distance cable will generate a strain or torque, which tends to disrupt the connection between the cable and the radio on the PCB. A strain relief apparatus is used to isolate the cable movement and the actual electrical joint between the connector and the cable. Various kinds of strain relief solutions are available. The strain relief apparatus for RF cabling involving mil-specifications provides special challenges and requires advanced solutions.

An embodiment of the present invention provides a solution that does a couple of things different than current products. It solves the centering of the contacts within the cavity and allows minimum movement of the contact in case the cables are moved or routed to one side to the other. It also reduces the amount of space verse the standard strain relief products. In another embodiment of this solution, an improvement is achieved in the capability of reworking a failed cable assembly. There is no more requirement to scrap the completed cable assembly. In one embodiment of the present invention, one has to just remove the failed cable and replace it with a new one. This design also is much smaller and can be adapted for smaller spaces. It also utilizes the existing mounting hole of the connector. In one embodiment, there is no need to screw on a strain relief back shell.

In order to restrict the movement around the points of joining of the connector and the cable, or where connector joins a cable to another cable, the traditional solution is a "potted" version. The strain relief apparatus is potted or joined through epoxy materials which includes the multi cable apparatus. If there is a failure, there is no way to remove the "potting" materials. The materials setups to a very solid state, that requires a "grinder" to remove, ensuring again that there is no way to replace a failed cable. The present embodiment does not use any type of "potting" process. Therefore, having to rework a failed cable is just a matter of removing, sliding the strain relief back to allow an insertion/extraction tool to be used. The method merely involves removing the failed cable and replacing it with a new one. The sliding clamp (strain relief) is part of the new invention. It replaces the standard strain relief (back shell) that is used for the "potting" process.

In one embodiment, in order to accommodate small spaces, it's a matter of changing the "thickness" of the new invention. In one application, one embodiment of the invention involves thickness of approximately 1.75 inches, which is the smallest to date. In other embodiments of the invention, the thickness ranges from 1.75 to 3.00 inches. In one latest embodiment, the invention has a cable clamp, which allows the cables to be secured to one of four directions.

FIG. 1 100 illustrates as one embodiment, the strain relief apparatus. The connector 105 is attached to a back shell 104 using the mounting holes on the connector. A set for the purpose of illustration of three cables 103 are shown traversing the aligned holes of the back shell and the connector. The cables are then turned in one of the four directions and pressed or clamped using a clamp with a shrink tubing 102 using screws and washers 101. The clamp provides the strain relief. No potted material is involved and any bad cable can be replaced individually by disassembly of clamp 102 and back shell 103.

Figure 2:
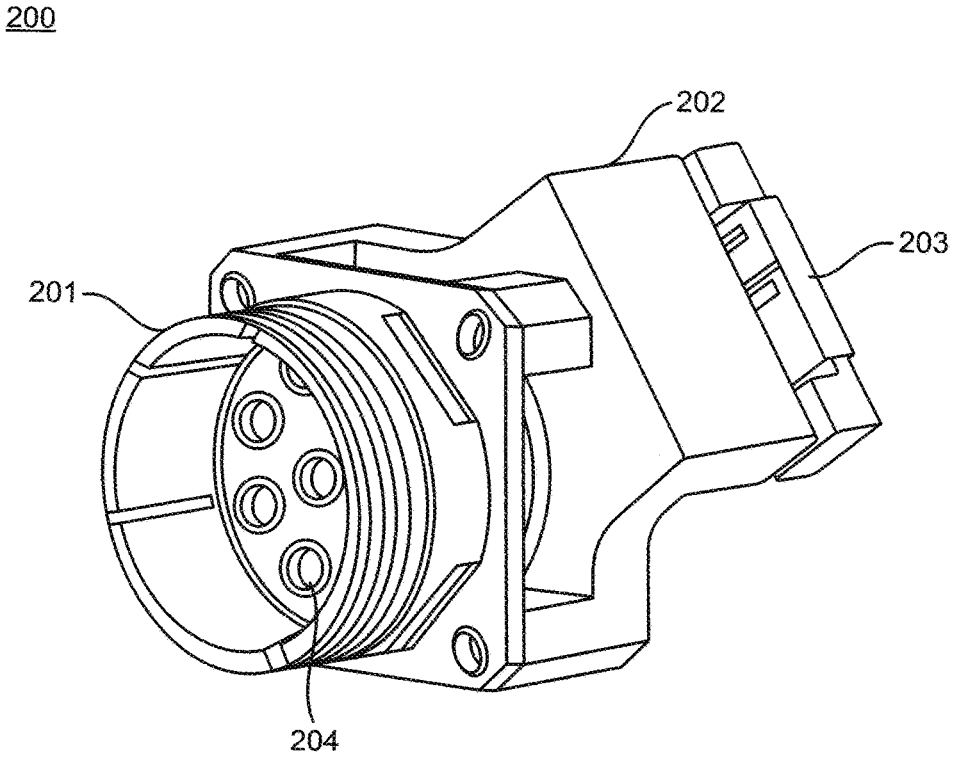
FIG. 2 is one embodiment of an illustration of the strain relief solution proposed in the present invention. An isometric view is again shown. The four corner holes on the connector line up with the corresponding holes with the back shell to show the attachment assembly. In isometric view, the holes for cables are shown on the connector, which line up with corresponding holes on the back shell. No cables are shown.

FIG. 2 200 shows an isometric view of the assembly from another angle. The connector 201 is shown with holes for the cables 204. The back shell 202 is attached to the connector 201. A clamp with shrink tubing is 203 is attached to the back shell 202 through screws which are hidden in this view. The illustration shows how the connector 201 attaches to the back shell 202. The actual RF cables are not shown in this illustration.

Figure 3:
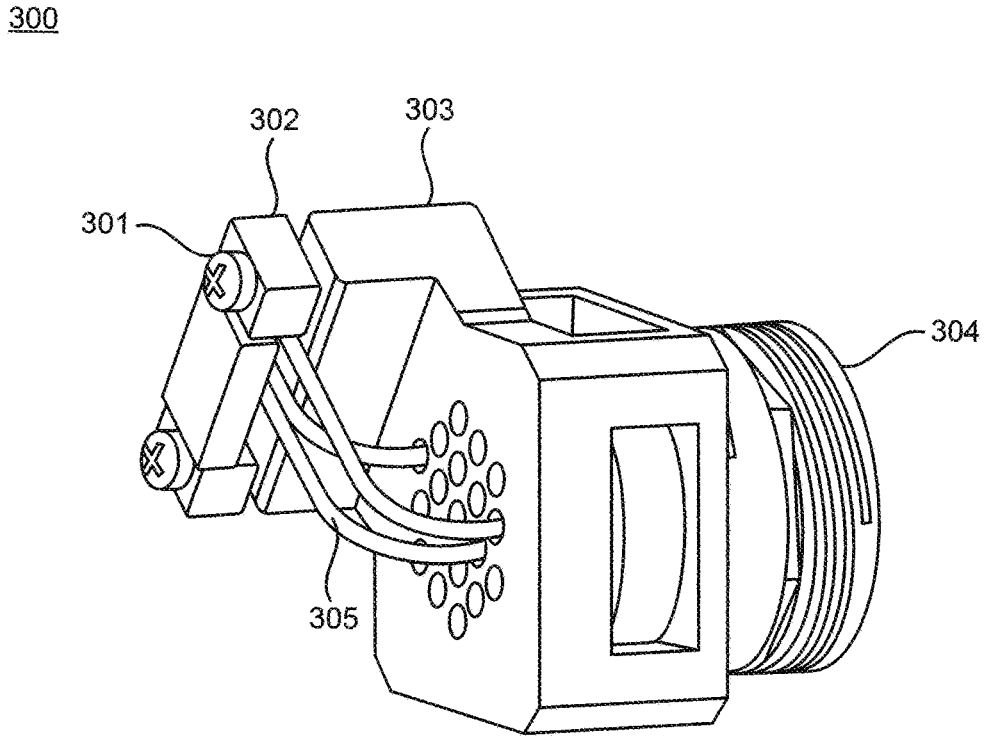
FIG. 3 is an embodiment of an isometric view from another angle. The back shell is shown attached to the connector with the holes of back shell lining up with that of the connector for the passage of cables. Three sets of cable are shown going through the connector, back shell and clamp with shrink tubing. The screws are shown to be placed to attach the clamp to the back shell. For the cables traversing away from the clamp for long distances, the clamp acts to absorb strain and protects the joint between cables and connectors.

FIG. 3 300 is an illustrative embodiment of the apparatus from another isometric view. Connector 304 is attached to back shell 303 and the cables 305 are shown to traverse the back shell 303 and the connector 304. The cables 305 are pressed or clamped using clamp 302 attached to the back shell 303 through screw set 301. There is no potted or epoxy material involved. The strain relief is provided by the clamp 302.

Figure 4:
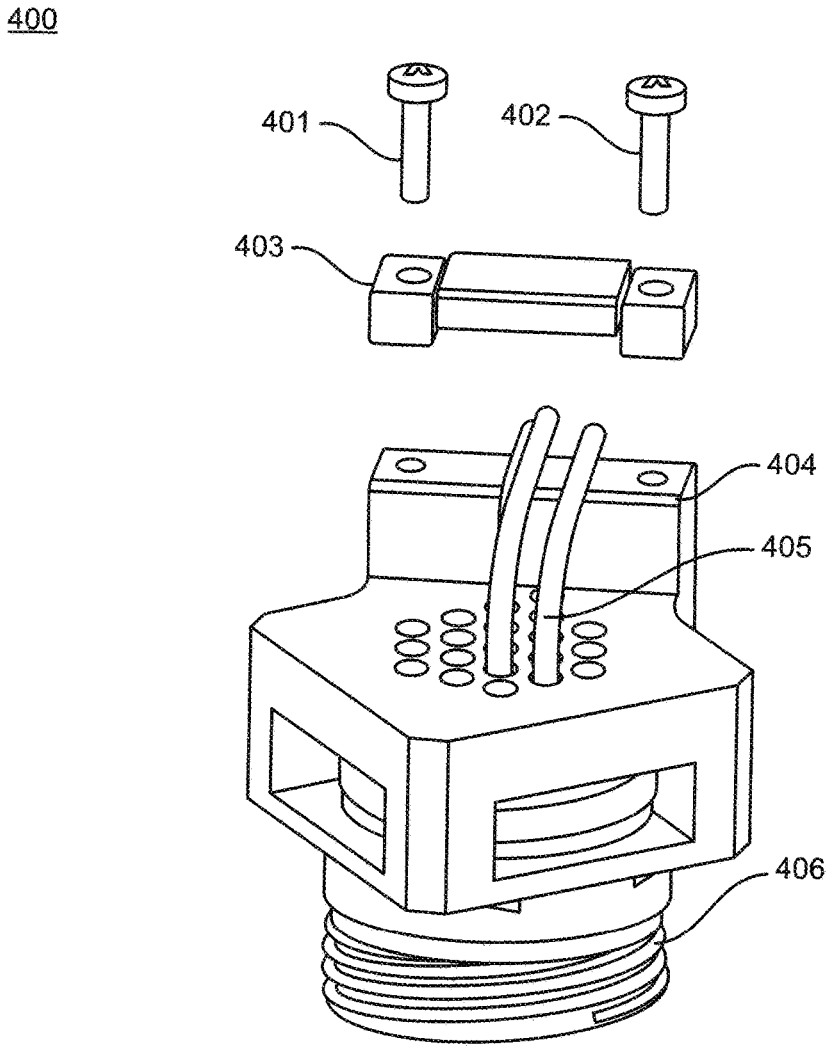
FIG. 4 is another embodiment of an illustration of the part by part assembly and apparatus. The metallic connector is shown in an isometric view, attached to the back shell with a set of three cables going through the aligned holes of the back shell and connector. The clamp is shown detached, but lined up to connect to the back shell. The two screws and washer are also separated but shown to line up with holes on the clamps.

FIG. 4 400 is another embodiment that shows piece wise components 401 402 403 404 405 406 and their corresponding place in the apparatus 400. The connector in this embodiment, as an illustration is size 25 406. The connector 406 is attached to back shell 404 and cables traverse 405. The clamp 403 is shown to attach the back shell 404 through screws 401 and 402. The strain relief is provided by clamp 403. No epoxy or potted material is involved and each individual cable can be replaced.

Figure 5:
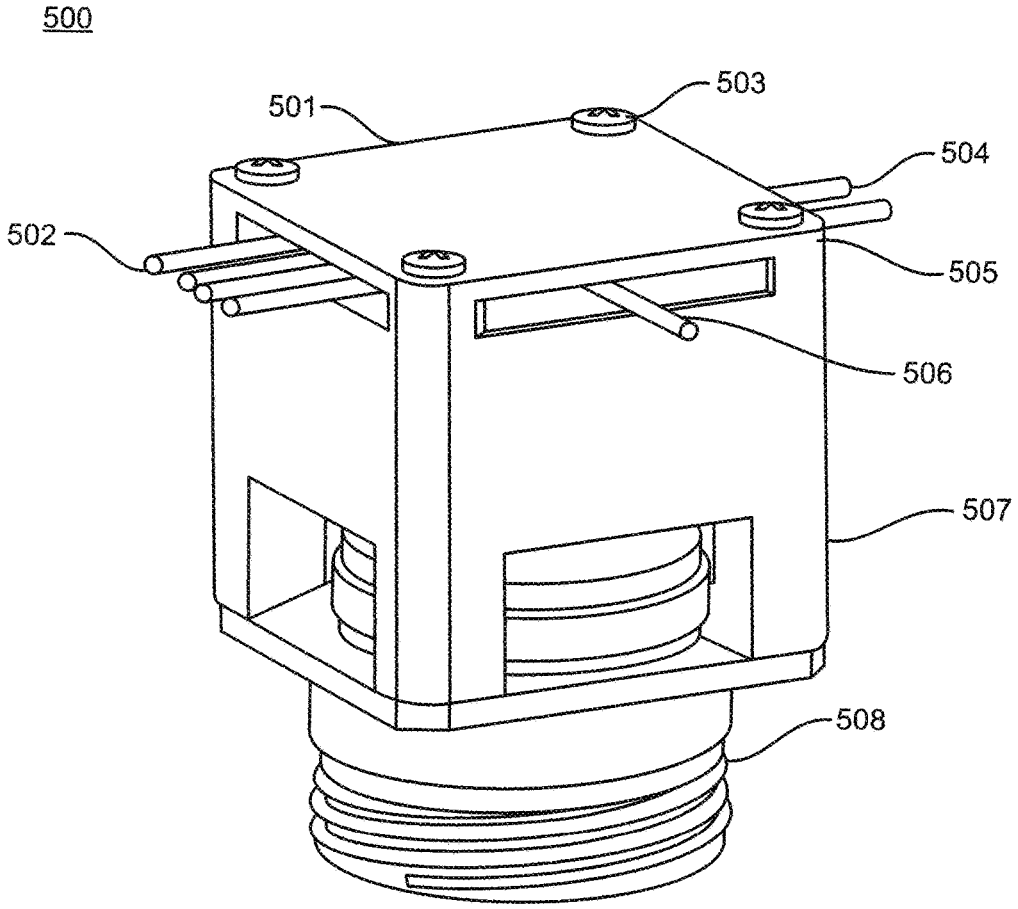
FIG. 5 is an embodiment of the invention, where the cover or clamp is extended in all four directions. The back shell attaches to the connector and the clamp is attached to the back shell using four screws, one in each direction. The back shell is shaped to have gaps or cavities through which the cables would turn and pass in each of the four directions.

FIG. 5 500 represents another embodiment where the one directional clamp or cover is replaced with a single clamp 505 or cover 505 providing for the ability to turn the cables 504 502 506 501 in each direction through single assembly 500. The clamp or cover 505 is attached to back shell 507 using four screws 503. The back shell 507 is designed to have cavities in each dimension, to be covered using the clamps in each direction. The cables are turned 504 502 506 501 and sent outwards through these cavities from the connector 508.

FIG. 5.1 5100 represents the apparatus of FIG. 5 in an isometric connector 5108 front view with multiple coaxial cables 5107 shown in one embodiment, the connector 5108 attached to the back shell 5104, which in turn attaches to a clamp or cover 5102, providing cavities in each direction for the cables 5106 5101 5103 to go outwards from the connection points 5107 in each direction. In this embodiment, the clamp or cover 5105 is attached also to the other side of the back shell towards the connector 5108.

FIG. 5.2 5200 is the isometric view of the cover of clamp front embodiment of the apparatus, showing the screws 5202 connecting the cover or clamp 5203 5205 to the back shell 5206 with a connector 5207 and with cables 5201 5203 5204 going outwards in each direction through predesigned cavities between the back shell 5206 and the cover 5205. Through the turns effectuated, the stress point is not the electrical or physical connection point, which relives stress at the same points.

Figure 6:
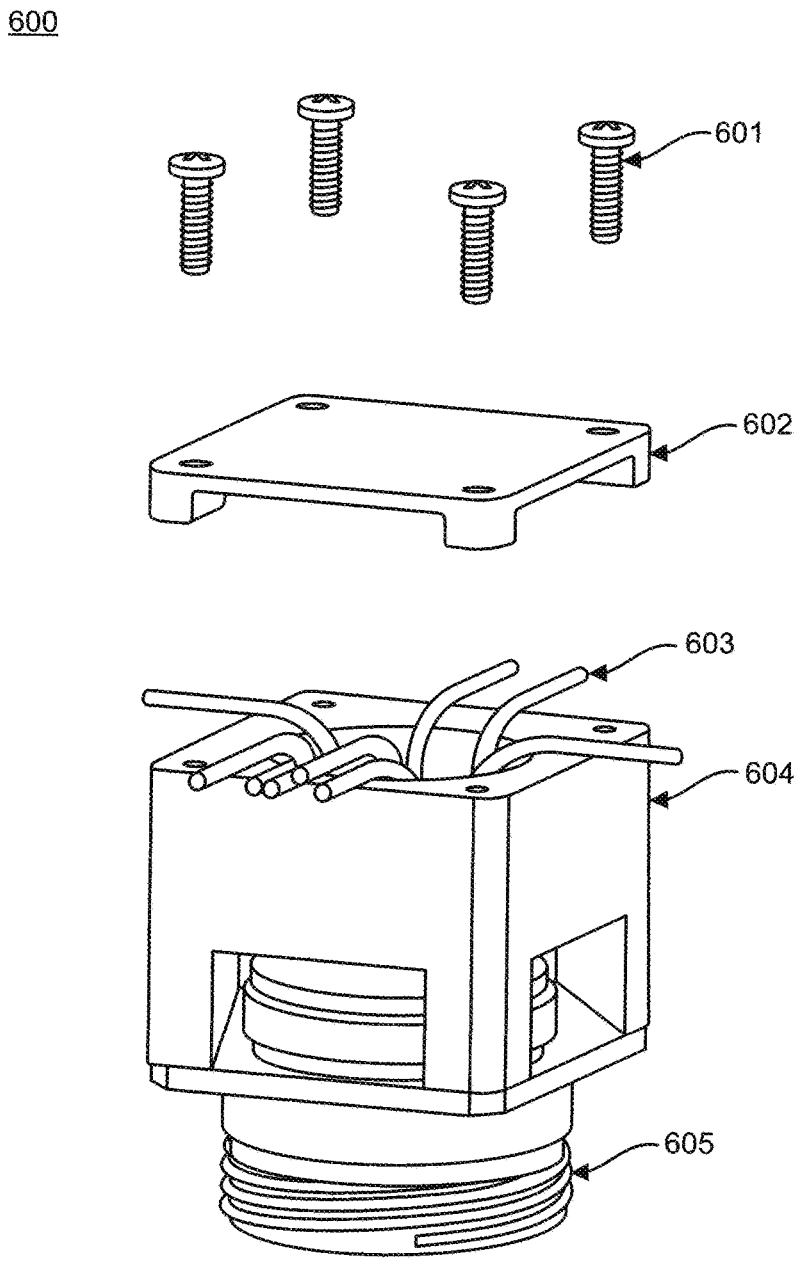
FIG. 6 is an isometric view showing the assembly of the entire apparatus in one embodiment. The connector is seen attached to the back shell, with cables turned after connection. The clamp or cover is shown, detached and ready to be attached to the back shell using the four screws. The cavities or gaps are designed in the back shell to be able to turn the cables in each direction, if necessary.

FIG. 6 600 shows the assembly in one embodiment, where four screws 601 are used to attach a clamp or cover 602 to the back shell 604, which in turn attaches to a connector 605. The cables 603, going through connector 605 are shown to be turned in each direction, with no or little stress at the connection point.

Figure 7:
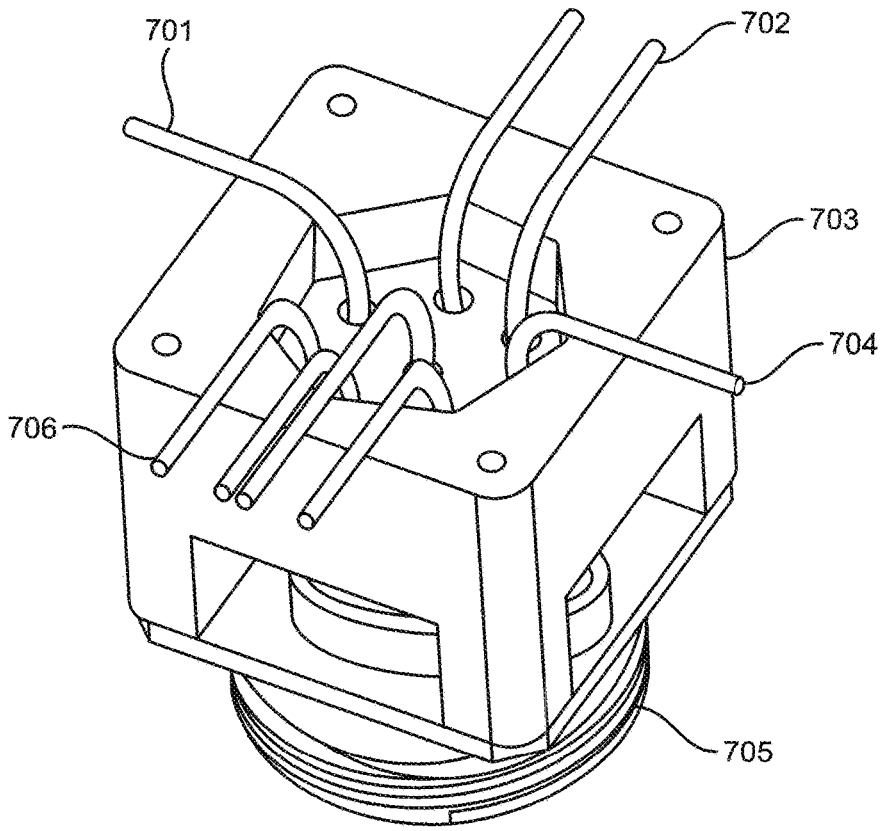
FIG. 7 is an isometric view of the embodiment, with the cover or clamp detached, showing the attachments of the connector to back shell and the cables turned in each of the four directions, prior to attachment of the clamp or cover using the screws.

FIG. 7 700 shows an isometric view of the assembly with cover or clamp removed. The connector 705 is attached to back shell 704 and the cables 704 702 701 706 are shown to be bent towards and outwards from the connection points. The holes are shown on the back shell so that the cover of clamp may be used to attach to it through screws not shown.

Figure 8:
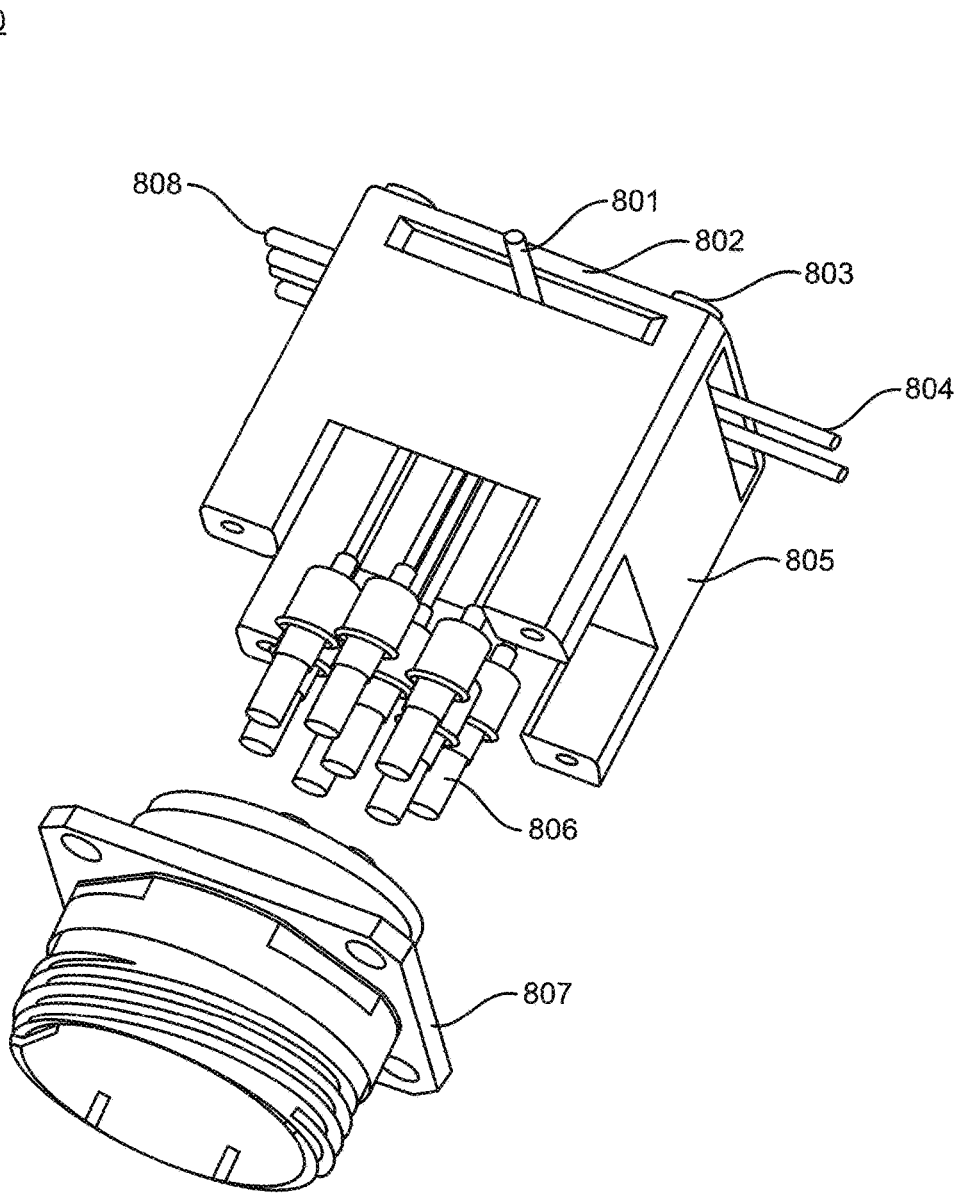
FIG. 8 is an isometric view showing the connector detached and about to be attached to the rest of the apparatus. The clamp or cover is attached to the back shell and the cables, in one embodiment being coaxial cables, are seen to be about to be placed through the connector to their mates for electrical physical connection.

FIG. 8 800 shows an isometric view of the apparatus, showing further the assembly. The connector 807 attaches to back shell 805, which in turn is attached to a cover or clamp 803 through screws (not shown), with cables 806 804 808 801 coming outwards in each direction. In this embodiment, the coaxial cables 806 804 808 801 are shown to be going through the connector and making the electrical connection with mates, with stress relieved form those points due to the use of the assembly.

This invention makes the RF cabling strain relief, as some embodiments, much more compact and flexible. The key differentiator is that no potted or epoxy materials are used and this allows for a single cable replacement on failures rather than discarding the entire mesh of cables. It is stated that while for illustrative purpose, an RF cable connector is chosen for strain relief, it can be used for any such or other cables or wires. It is also apparent to those skilled in the art, that is, to those who have knowledge and experience in this area of technology that the description above explains just one to two of many possible design variations. The examples provided above are exemplary only and are not intended to be limiting. One skilled in the art may readily devise other systems consistent with the disclosed embodiments which are intended to be within the scope of this disclosure.

The invention claimed is:

1. A RF cable connector assembly, comprising:

a back shell attached to a connector with a plurality of holes and;

a clamp, shrink tubing or cover attached to back shell and;

a plurality of cavities between the back shell and the clamp, shrink tubing or cover are used to pass a plurality of RF cables with a plurality of pins attached to a plurality of connectors.

2. The RF cable connector assembly of claim 1 where the back shell can be reoriented to provide the clamping in any desired direction.

3. The RF cable connector assembly of claim 1 where the back shell remains attached to the connector solely by the plurality of cables passing through.

4. The RF cable connector assembly of claim 1 where the back shell is physically attached to the plurality of connectors.

5. The RF cable connector assembly of claim 1 where the back shell is used for improved alignment between the plurality of connected cables at the connector.

6. The RF cable connector assembly of claim 1 where a thickness of the back shell, the shrink tubing and the clamp is used to provide accommodation to small spaces leading to better integration.

7. The RF cable connector assembly of claim 1 where the cable is individually repairable or replaceable.

8. A RF cable connector assembly method, comprising:

a back shell attached to a connector with a plurality of holes and;

a clamp, shrink tubing or cover attached to back shell and;

a plurality of cavities between the back shell and clamp, shrink tubing or cover are used to pass a plurality of RF cables with a plurality of pins attached to a plurality of connectors.

9. The RF cable connector assembly method of claim 8 where the back shell can be reoriented to provide the clamping in any desired direction.

10. The RF cable connector assembly method of claim 8 where the back shell remains attached to the connector solely by the plurality of cables passing through.

11. The RF cable connector assembly method of claim 8 where the back shell is physically attached to the connector.

12. The RF cable connector assembly method of claim 8 where the back shell is used for improved alignment between the plurality of connected cables at the plurality of connectors.

13. The RF cable connector assembly method of claim 8 where a thickness of the back shell, the shrink tubing and the clamp is used to provide accommodation to small spaces leading to better integration.

14. The RF cable connector assembly method of claim 8 where the cable is individually repairable or replaceable.

* * * * *